US005153383A

United States Patent [19]

Whited et al.

[11] Patent Number: 5,153,383

[45] Date of Patent: Oct. 6, 1992

[54] ELECTRICAL INSULATOR PROTECTOR

[75] Inventors: Gary L. Whited, Kirkersville; James R. Stillwagon, Worthington, both of Ohio

[73] Assignee: Gary Guard, Inc., Columbus, Ohio

[21] Appl. No.: 761,675

[22] Filed: Sep. 18, 1991

[51] Int. Cl.[5] ..... H01B 7/28

[52] U.S. Cl. ..... 174/135; 174/5 R; 174/138 F

[58] Field of Search ..... 174/135, 136, 138 F, 174/5 R, DIG. 11, 1, 161 R; 138/167, 168; 24/442, 450; 150/154, 901

[56] References Cited

U.S. PATENT DOCUMENTS

| | | | |
|---|---|---|---|
| 2,770,667 | 11/1956 | Runde | 174/5 |
| 3,019,287 | 1/1962 | Newcomb, Jr. et al. | 174/138 F |
| 3,491,847 | 1/1970 | Abbott | 150/154 X |
| 3,941,159 | 3/1976 | Toll | 24/442 X |
| 4,707,562 | 11/1987 | Whited | 174/5 |

OTHER PUBLICATIONS

Abandoned application Ser. No. 833,615 filed Aug. 13, 1959 and referred to in U.S. Pat. No. 3,019,287, Newcomb, Jr.

*Primary Examiner*—Leo P. Picard
*Assistant Examiner*—Hyung S. Sough
*Attorney, Agent, or Firm*—Michael Sand Co.

[57] ABSTRACT

A flexible sheet of material for mounting about a vertical or horizontal type porcelain insulator of electrical equipment to physically protect the insulator from falling objects during maintenance when the electrical equipment is deenergized. The sheet is formed of flexible PVC material and is foldable into a conical configuration and secured about the insulator by VELCRO strips attached to the sheet. Additional rectangularly-shaped sheets of similar material also are provided with VELCRO fasteners are formed into a cylindrical configuration and placed around the insulator and secured to the conically wrapped sheet to provide physical protector for taller porcelain insulators.

16 Claims, 4 Drawing Sheets

ELECTRICAL INSULATOR PROTECTOR

BACKGROUND OF THE INVENTION

1. Technical Field

The invention relates to electrical equipment and in particular to a protection device to provide physical protection to the porcelain insulators of electrical equipment such as transformers, capacitors, circuit breakers or the like, located in electrical substations to prevent chipping of the porcelain insulator caused by falling debris during maintenance work in the substations. More particularly, the invention relates to such a protection device which is formed of one or more flexible sheets of material, one of which is cone-shaped, which are secured around the insulator by fasteners attached to the sheet material.

2. Background Information

When providing electricity to the consuming public, the power is transmitted from generating plants to the customers via a network of transmission and distribution lines. In the process of this electrical transmission, there are a vast number of substations to step up or step down the voltage as needed.

While performing maintenance in the substations, such as repairing switches, painting or other various activities, there is a need to protect the porcelain bushings of transformers, circuit breakers, capacitors and the like from overhead debris. Falling debris such as paint, bolts, weld splatters and the like, can cause a costly repair or replacement of an insulator bushing. Currently, the only known means of protecting these insulators range from using packing foam which is taped to the insulator to the use of expensive protective dielectric rubber goods or rubber blankets used for "hot line" work, which rubber goods are wrapped about the insulators. Use of such dielectric rubber goods is extremely expensive since these rubber goods are designed for "hot line" applications and must be periodically checked for leaks and have a relatively short life span.

Therefore, the need has existed for a device which can be used for various sizes and shapes of electrical insulators of the type used on high voltage transformers, circuit breakers and the like, which can be installed easily about the insulator when the attached conductor is in a deenergized condition to provide physical protection thereto while work is being performed above the insulator in a substation or similar electrical equipment site. There is no known prior art device which provides such an inexpensive and readily used device for such applications.

SUMMARY OF THE INVENTION

Objectives of the invention include providing an electrical insulator protector which is of an inexpensive design, which can be installed with existing work methods and without complicated attachment devices in seconds without the need of removing the conductor leads extending from the top of the insulator, and which is relatively lightweight and easy to handle and which can be stored in a flat condition to reduce the size of storage space needed therefor.

A still further objective is to provide such an electrical insulator protector formed of readily available material such as a flexible lightweight PVC, which material can be formed easily into the desired conical or cylindrical configuration and secured in such formed position preferably by VELCRO type fasteners, which fasteners are bonded to the sheet material, yet which when unfolded can be stacked in a flat neatly stored position.

Still another objective of the invention is to provide such an electrical insulator protector which is easily adjusted for mounting on various diameter bushings, and which can be used in conjunction with other conical or cylindrical shaped protectors which are stacked one upon the other to protect different height insulators without requiring numerous sizes of the insulator protector, thereby reducing inventory cost for the electric utility or maintenance company.

A further objective is to provide such an electrical insulator protector which can be formed of a high visibility color thereby enabling it to be readily seen by workman to ensure that all insulators are properly covered and that none of the insulator protectors are left behind on the equipment after the work has been completed, and which will warn others of the overhead work being performed in a substation.

Another objective of the invention is to provide such an insulator protector which can be secured about an insulator, either vertical or horizontal, without removing the bushing lead wire from the electrical connector at the end of the insulator thereby saving installation time.

A still further objective of the invention is to provide such an insulator protector which is of a simple, maintenance free construction, which can be produced at a considerably less cost than existing protectors, and which satisfies needs existing in the art in an extremely safe and efficient manner.

These objectives and advantages are obtained by the protective device of the invention, the general nature of which may be stated as a single sheet of flexible material foldable into a conical configuration; and fastening means mounted on the sheet for securing said sheet into an adjustable conical configuration for mounting about the insulator.

BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
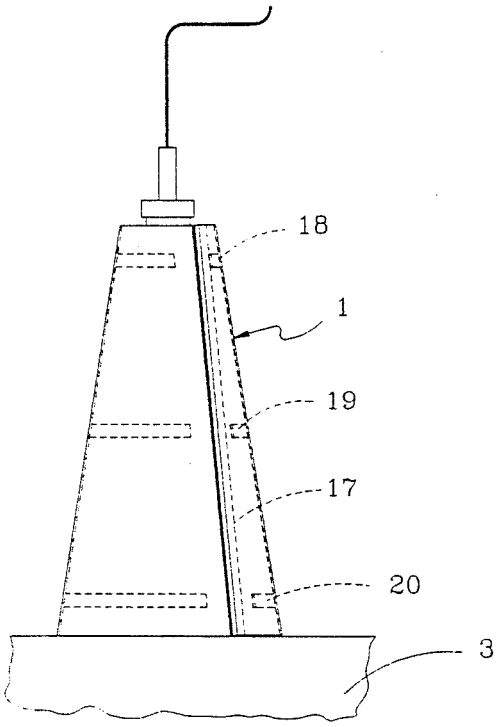
FIG. 1 is a side elevational view of the insulator protector mounted about a post type insulator on the top of electrical equipment.
Figure 2:
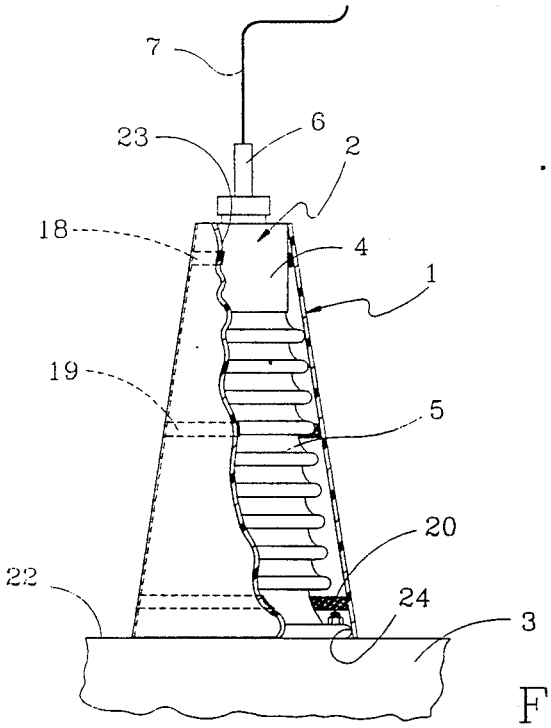
FIG. 2 is a view similar to FIG. 1 with portions broken away and in section.

The insulator protector of the invention is indicated generally at 1, and is shown particularly in FIGS. 1 and 2 mounted on an electrical post type insulator indicated generally at 2, which is attached to a piece of electrical equipment 3 and extends vertically upwardly therefrom. Insulator 2 is of a known construction generally consisting of a cylindrical top terminal end 4, a plurality of stacked porcelain discs or skirts 5, and a termination clamp 6 to which is connected a lead wire or conductor 7. Electrical equipment 3 usually will be a transformer, circuit breaker, capacitor or similar type of equipment found in most electrical substations. Insulator 2 may have other configurations than that shown in FIG. 2 and can vary in height from one to several feet and may have an outwardly expanding configuration as formed in FIG. 2, or the porcelain skirts may be truly vertical and of the same diameter. Likewise, the insulator may be a horizontally extending insulator without effecting the concept of the invention.

Figure 4:
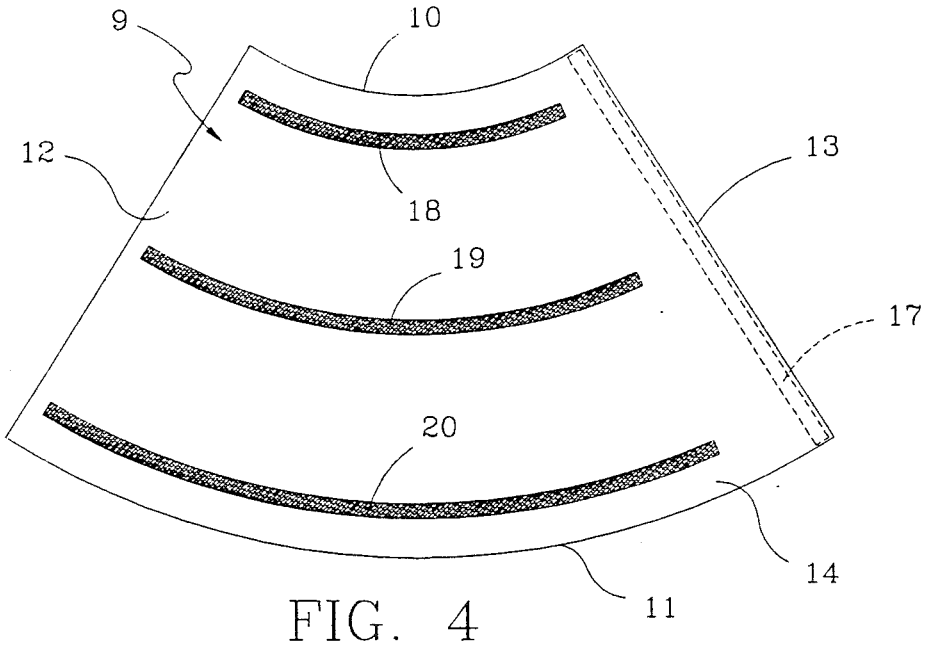
FIG. 4 is a plan view of the outside surface of the conical insulator protector of FIGS. 1 and 2 in an unfolded position.
Figure 5:
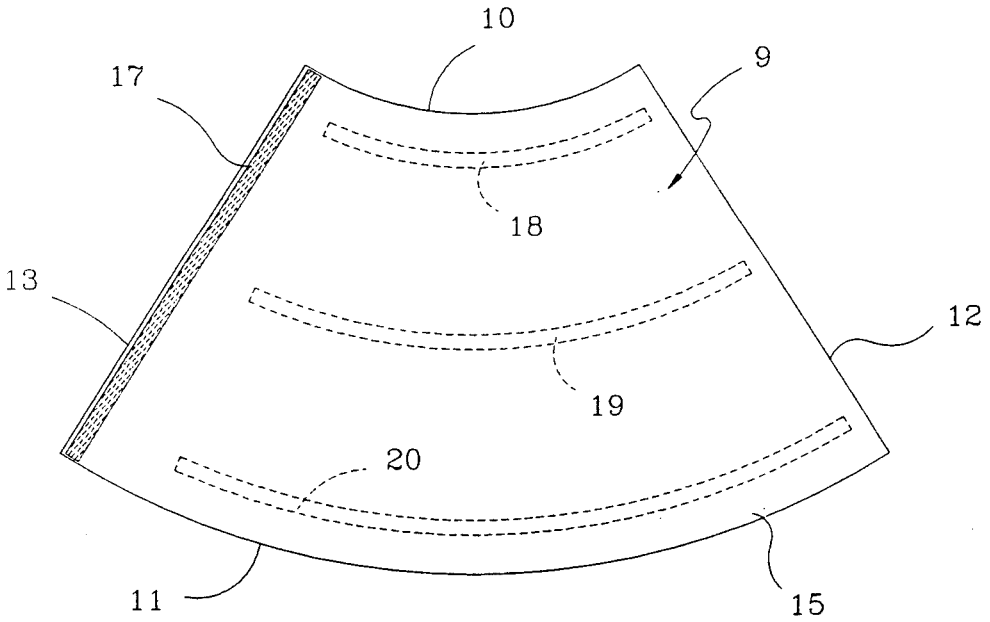
FIG. 5 is a plan view of the inside surface of the insulator protector of FIG. 4.
Figure 6:
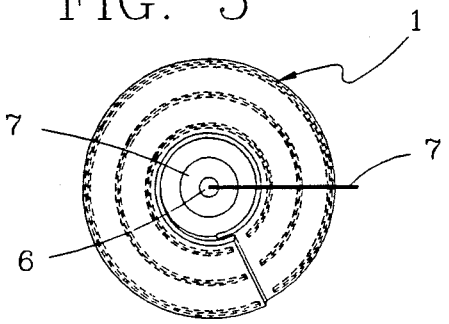
FIG. 6 is a top plan view of the conical insulator protector mounted about an insulator as shown in FIGS. 1-3.

Referring to FIGS. 4 and 5, protector 1 is shown in its unfolded position and is a one-piece sheet 9 of flexible material having a concaved top edge 10, a convexely shaped bottom edge 11, and a pair of side edges 12 and 13 extending therebetween. Protector 1 further includes a flat outer surface 14 and a similar flat inner surface 15. The single sheet 9 of material forming insulator 2 preferably is formed of a flexible resilient PVC material such as that used for the production of highway marking cones. One particular type of PVC material believed to be suitable would have a tensile strength of 1200 psi, an elongation of 200%, and a wall thickness of between 0.08 inches and 0.09 inches. Also, the sheet preferably will contain the required die or chemical to make it a bright orange or other highly visible color, as are most highway cones, to make it easily seen when in use. Sheet 9 may have other characteristics than those set forth above so long as it is durable and sufficiently flexible and resilient to be folded into a conical or cylindrical shape and then return to a flat condition for storage, and be able to deflect falling debris.

In further accordance with the invention, fastening means are formed on outer and inner surfaces 14 and 15 of insulator 2. In the preferred embodiment these fasteners include a single strip 17 of one component of a hook and pile fabric, which preferably is the hook portion thereof which is secured to inner surface 15 and extends along outer edge 13 thereof (FIGS. 4 and 5). Strip 17 preferably is secured to sheet 9 by an adhesive or other well known attachment means. A plurality of curved pile strips 18, 19 and 20 are attached to outer surface 14 of sheet 9, preferably in an equally spaced relationship. Strips 18-20 preferably have curved configurations generally complementary to that of curved top and bottom edges 10 and 11 and extend from adjacent side edges 12 and 13 throughout the transverse length of sheet 9. The fabric from which the various fastening strips are formed preferably is VELCRO.

The fastening means enables sheet 9 to be wrapped around insulator 2 when the attached conductor is de-energized, in an adjusted diameter by engagement of hook strip 17 with pile strips 18, 19 and 20 as shown particularly in FIGS. 1 and 2, with upper edge 10 being clamped tightly against top end 14 of the insulator. When sheet 9 is folded into its conical configuration bottom edge 11 lies in a horizontal plane as shown particularly in FIGS. 1 and 2 and may rest upon top surface 22 of electrical equipment 3 or suspended from top end 4 of insulator 2 as shown in FIG. 3, by tightly wrapping sheet 9 about insulator end 4 and contacting hook strip 17 with pile strips 18-20.

When sheet 9 is mounted on insulator 2 in its conical configuration as shown particularly in FIGS. 1 and 2, it provides a deflecting configuration which will physically protect porcelain skirts 5 of the insulator from falling debris. Upon any debris striking the sloped sidewalls of insulator 2, it will harmlessly bounce away preventing damage to the covered porcelain skirts. Thus, the natural resiliency and absorbency of the material of sheet 9, in combination with the angled sides of its conical configuration, together assist in protecting the covered porcelain skirts.

In accordance with another feature of the invention, the forming of the cone-shaped configuration of protector 1 with open top and bottom ends 23 and 24, will eliminate the disconnecting of conductor wire 7 from end terminal 6 or from disconnecting the mounting of insulator 2 from equipment 3 when installing insulator 1 thereon.

Figure 3:
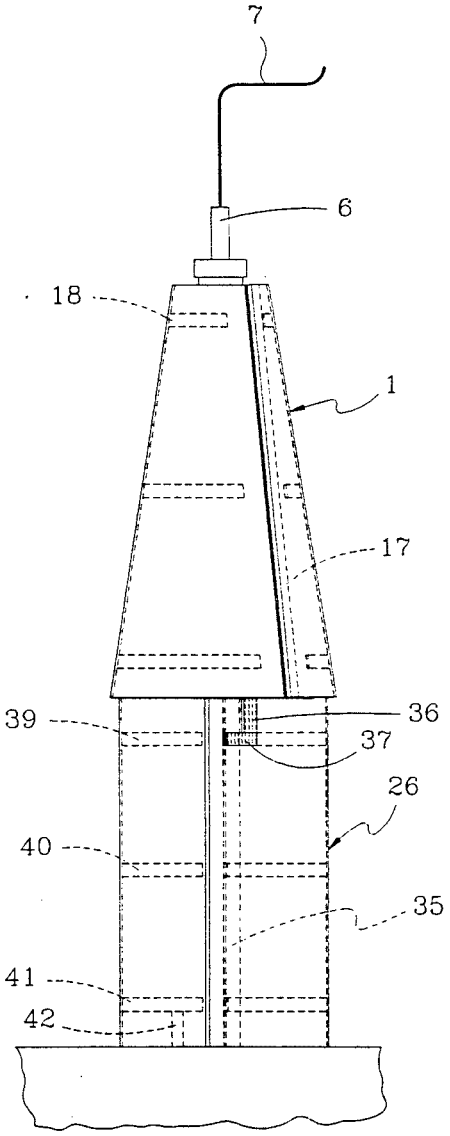
FIG. 3 is a view showing the conical shaped insulator protector of FIGS. 1 and 2 mounted in a stacked relationship with a cylindrical protector for protecting a tall insulator.
Figure 7:
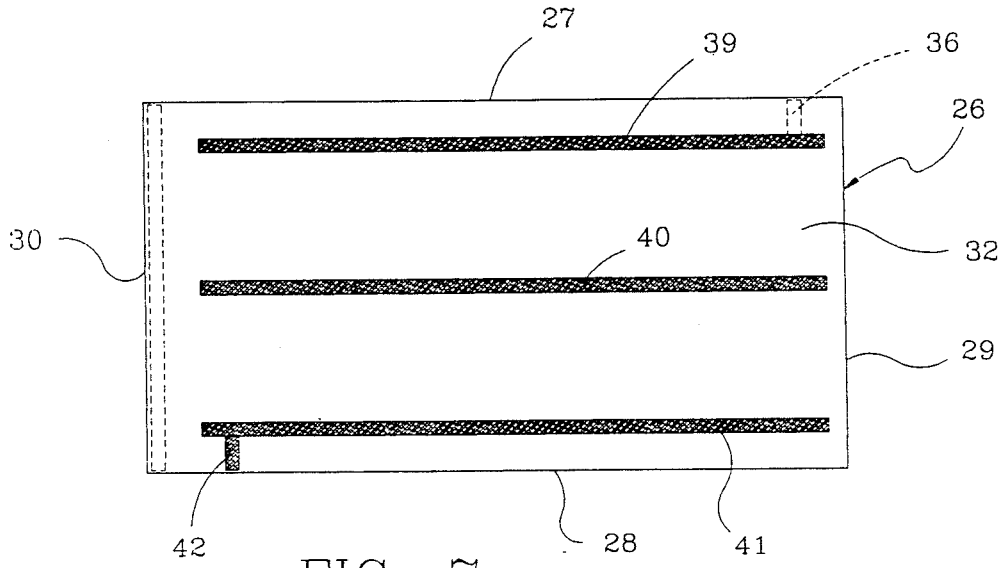
FIG. 7 is a plan view of the inside surface of a cylindrical shaped insulator protector in an unfolded position.
Figure 8:
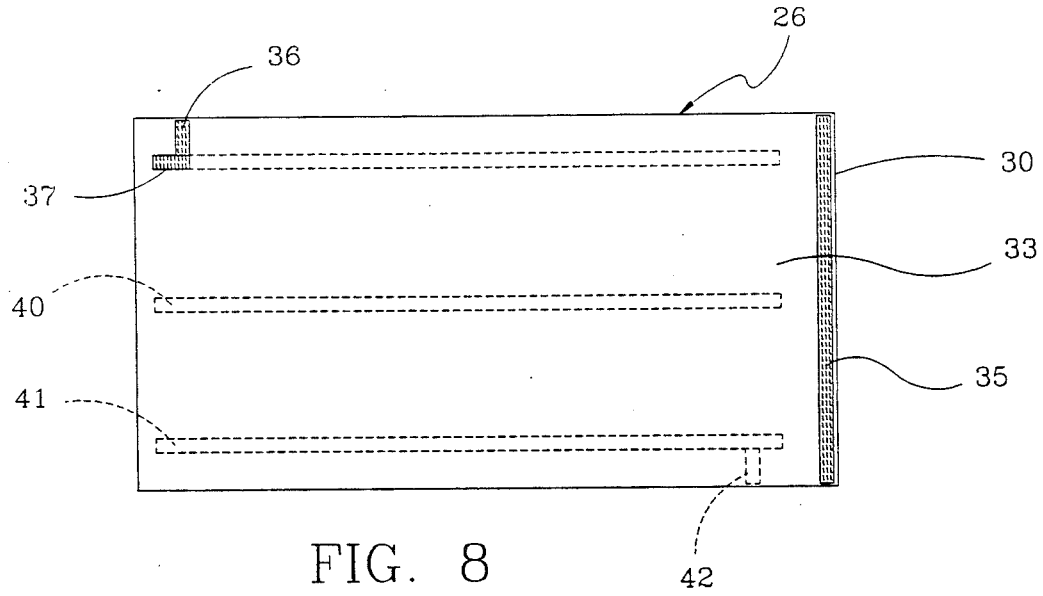
FIG. 8 is a plan view of the outside surface of the cylindrical insulator protector of FIG. 7.
Figure 9:
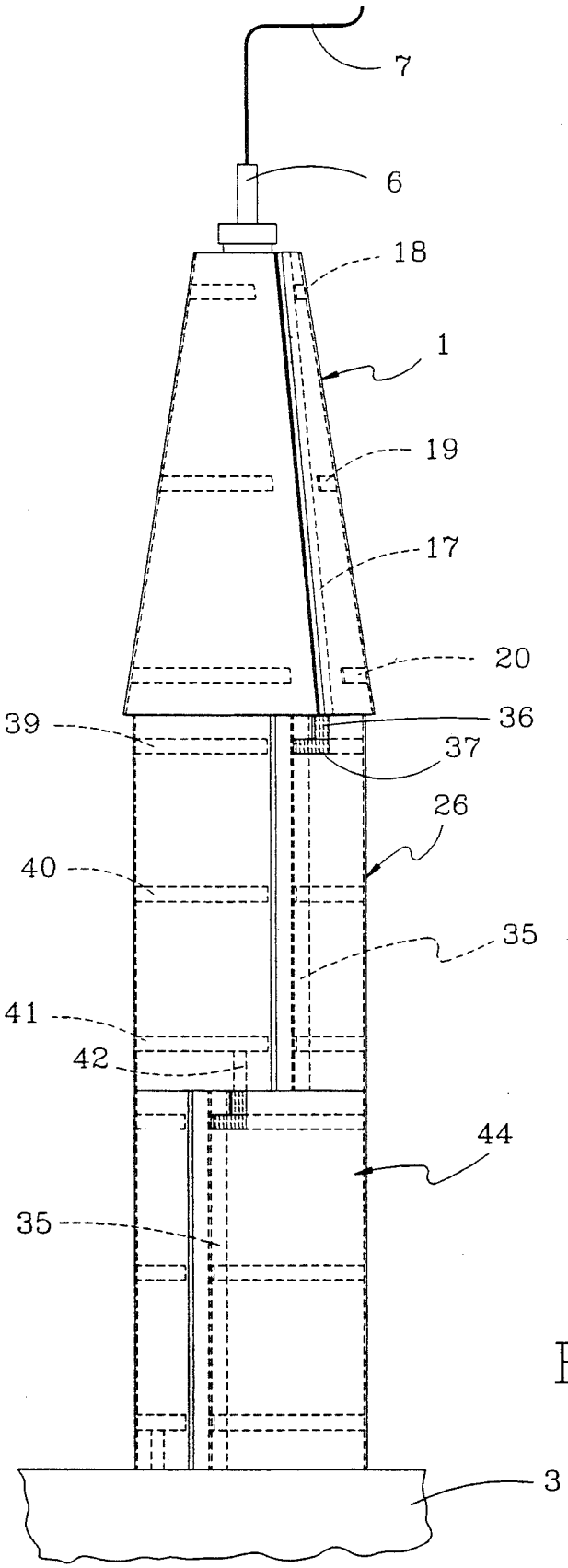
FIG. 9 is a side elevational view similar to FIG. 3, showing a pair of the cylindrical insulator protectors of FIGS. 7 and 8 in a stacked relationship with the conical insulator protector of FIGS. 1-3 on a relatively tall porcelain insulator.

In accordance with another feature of the invention, a second sheet of flexible material indicated generally at 26 (FIGS. 7 and 8) preferably of the same material as sheet 9, can be used in conjunction with coneshaped protector 1 to form a stacked arrangement as shown particularly in FIGS. 3 and 9, for protecting taller vertically extending insulators or longer horizontally extending insulators. This eliminates the manufacture and storage of a large number of sheets 9 for subsequent formation into the conical configuration. Sheet 26 preferably is formed of the same PVC material as sheet 9 discussed above, and has a rectangular configuration with spaced parallel top and bottom edges 27 and 28 and spaced parallel side edges 29 and 30. Sheet 26 also has an inside surface 32 and an outside surface 33. Sheet 26 also will include a plurality of strips of a hook and pile fabric to provide fastening means for securing the sheets into cylindrical configurations as shown in FIGS. 3 and 9, and for securing the cylindrically formed sheets in a stacked relationship with conically formed sheet 9 (FIG. 3) and with other cylindrical formed sheets 26 (FIG. 9), to enable the insulator protector to be used for various sizes of vertical or horizontal post type insulators without requiring excessively large sheets of the PVC materials either conically shaped as those of sheet 9 or the rectangular shape of sheet 26.

In the preferred embodiment of sheet 26, the particular hook and pile strips will consist of a strip of hook material 35 extending along longitudinal edge 30 on outside surface 33 (FIG. 8), together with a short vertical and horizontal strips 36 and 37 respectively, also formed of hook material in an upper corner of sheet 26 opposite strip 35. Likewise, a plurality of equally spaced horizontal pile strips 39, 40 and 41 (FIG. 7) will be secured to inside surface 32 and will be engaged by hook strip 35 when rolled into a cylindrical configuration. Another short vertical strip 42 of pile material is mounted on inside surface 32 adjacent an end of bottom pile strip 41 for engagement with hook strip 36 of an adjacent lower second cylindrical shaped protector 44 as shown in FIG. 9 to form the stacked configuration.

The various strips of hook and pile fabric are commonly referred to under the trademark VELCRO and preferably will be of polyester which is less effected by moisture and weather than if formed of nylon. Likewise, other types of fastening devices such as hooks, snap fasteners or the like, could be used without affecting the main concept of the invention but it is believed that the VELCRO fastening system is preferred and is easier to use and is less susceptible to breakage and damage, and enables the sheets of PVC material to be laid flat when unfolded from their conical and cylindrical configurations for ease of handling and storage.

Accordingly, the electrical insulator protector of the invention is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved electrical insulator protector is constructed and used, the characteristics of the construction, and the advantageous, new and useful results obtained; the new and useful structures, devices, elements, arrangements, parts and combinations, are set forth in the appended claims.

We claim:

1. A protective device for an electrical insulator including a single sheet of flexible material foldable into a conical configuration; and fastening means for securing said sheet of material into an adjustable conical configuration, said fastening means includes a strip of one component of a hook and pile fabric extending longitudinally along and adjacent to one of the side edges on one of the sheet surfaces, and a plurality of transversely extending strips of a mating second component of the hook and pile fabric extending along the other surface of the sheet of material.

2. The protective device defined in claim 1 in which the sheet of flexible material has inner and outer surfaces, a concavely curved top edge., a convexely curved bottom edge, and a pair of side edges extending between said top and bottom edges.

3. The protective device defined in claim 1 in which the transversely extending strips of the hook and pile fabric are generally complementary with the curvature of the top and bottom edges of the sheet of material.

4. The protective device defined in claim 3 in which the transversely extending strips of the hook and pile fabric are generally equally spaced on the outer surface of the sheet of material; and in which the longitudinally extending strip of hook fabric is mounted on the inner surface of the sheet of material.

5. The protective device defined in claim 1 in which the sheet of material is formed of PVC.

6. The protective device defined in claim 1 in which the bottom edge of the sheet material when folded into its conical configuration lies in a common plane.

7. In combination, a vertical insulator of electrical equipment and a protective sheet of flexible material formed into a conical configuration and secured about an upper portion of the insulator to protect portions thereof, said protective sheet being a one-piece member having a concavely curved top edge, a convexely curved bottom edge and a pair of side edges extending therebetween; and fastening means for forming the sheet into its conical configuration and for securing it about the upper portion of the insulator, said fastening means includes a strip of one component of a hook and pile fabric extending longitudinally along and adjacent to one of the side edges on one of the sheet surfaces, and a plurality of transversely extending strips of a mating second component of the hook and pile fabric extending along the other surface of the sheet of material.

8. The protective device defined in claim 7 in which a one-piece rectangularly-shaped sheet of flexible material includes fastening means for securing said sheet into a cylindrical configuration and for securing said cylindrically-shaped second sheet onto the bottom of the conically-shaped sheet of material about the insulator.

9. The protective device defined in claim 8 in which the fastening means of the rectangularly-shaped of material is a plurality of strips of a hook and pile fabric.

10. A protective device for an electrical insulator including a first sheet of flexible material foldable into a conical configuration; first fastening means for securing said first sheet of material into an adjustable conical configuration; a second sheet of flexible material foldable into a cylindrical configuration; and second fastening means for securing said second sheet in the cylindrical configuration and for attaching said second sheet to the first sheet of material in a stacked configuration on an electrical insulator.

11. The protective device defined in claim 10 in which the second sheet of flexible material is rectangularly-shaped when in an unfolded condition.

12. The protective device defined in claim 11 in which the second sheet of material includes inner and outer surfaces, a pair of spaced top and bottom edges, and a pair of spaced side edges.

13. The protective device defined in claim 12 in which the second fastening means includes a first strip of one component of a hook and pile fabric extending along one side edge on one of the surfaces and a plurality of strips of the other component of the hook and pile fabric extending along the other surface generally perpendicular with respect to said first strip for engagement with said first strips for forming the second sheet of material into a rectangular configuration.

14. The protective device defined in claim 13 in which the second fastening means further includes at least one short strip of one component of a hook and pile fabric mounted on each of the sides of the second sheet of material located adjacent the top and bottom edges for engagement with a mating component of the hook and pile fabric on the first sheet of material for securing together in a stacked relationship said first and second sheets of material.

15. The protective device defined in claim 10 in which portions of the first and second fastening means are engageable with each other to form a stacked configuration about an insulator with the conically formed first sheet being above the cylindrically formed second sheet of material.

16. In combination, a vertical insulator of electrical equipment and a first protective sheet of flexible material formed into a conical configuration and secured about an upper portion of the insulator to protect portions thereof, said first protective sheet being a one-piece member having a concavely curved top edge, a convexely curved bottom edge and a pair of side edges extending therebetween; first fastening means for forming the said first sheet into its conical configuration and for securing it about the upper portion of the insulator; a one-piece rectangularly-shaped second sheet of flexible material; and second fastening means for securing the said second sheet into a cylindrical configuration for securing it about the insulator adjacent the bottom edge of the conically-shaped first sheet of material.

* * * * *